US009938612B2

(12) United States Patent
De Smet

(10) Patent No.: US 9,938,612 B2
(45) Date of Patent: Apr. 10, 2018

(54) METHOD OF MANUFACTURING AN AL—MG—SI ALLOY ROLLED SHEET PRODUCT WITH EXCELLENT FORMABILITY

(71) Applicant: ALERIS ALUMINUM DUFFEL BVBA, Duffel (BE)

(72) Inventor: Peter De Smet, Sint-Martens-Latem (BE)

(73) Assignee: ALERIS ALUMINUM DUFFEL BVBA, Duffel (BE)

( * ) Notice: Subject to any disclaimer, the term of this patent is extended or adjusted under 35 U.S.C. 154(b) by 400 days.

(21) Appl. No.: 14/770,606

(22) PCT Filed: Feb. 18, 2014

(86) PCT No.: PCT/EP2014/053100

§ 371 (c)(1),
(2) Date: Aug. 26, 2015

(87) PCT Pub. No.: WO2014/135367

PCT Pub. Date: Sep. 12, 2014

(65) Prior Publication Data

US 2016/0002761 A1 Jan. 7, 2016

(30) Foreign Application Priority Data

Mar. 7, 2013 (EP) ..... 13158176

(51) Int. Cl.

| | |
|---|---|
| ***B22D 7/00*** | (2006.01) |
| ***C22F 1/043*** | (2006.01) |
| ***C22C 21/04*** | (2006.01) |
| ***C22C 21/06*** | (2006.01) |
| ***C22F 1/047*** | (2006.01) |
| ***C22C 21/02*** | (2006.01) |
| ***C22C 21/08*** | (2006.01) |
| ***C22F 1/00*** | (2006.01) |

(52) U.S. Cl.

CPC ..... *C22F 1/043* (2013.01); *B22D 7/005* (2013.01); *C22C 21/02* (2013.01); *C22C 21/04* (2013.01); *C22C 21/06* (2013.01); *C22C 21/08* (2013.01); *C22F 1/00* (2013.01); *C22F 1/002* (2013.01); *C22F 1/047* (2013.01)

(58) Field of Classification Search

CPC ..... C22F 1/047; C22F 1/043; B21B 3/00

USPC ..... 148/552

See application file for complete search history.

(56) References Cited

U.S. PATENT DOCUMENTS

| | | | | |
|---|---|---|---|---|
| 4,174,232 | A | 11/1979 | Lenz et al. | |
| 6,334,916 | B1 | 1/2002 | Matsumoto et al. | |
| 2006/0032560 | A1* | 2/2006 | Benedictus | C22F 1/04 148/552 |
| 2017/0204503 | A1* | 7/2017 | Aruga | B21B 3/00 |

FOREIGN PATENT DOCUMENTS

| | | | |
|---|---|---|---|
| EP | 1029937 | A1 | 8/2000 |
| WO | 9814626 | A1 | 4/1998 |

OTHER PUBLICATIONS

International Search Report and the Written Opinion dated May 20, 2014 for International Patent Application No. PCT/EP2014/053100 to Aleris Aluminum Duffel BVBA having an International filing date of Feb. 18, 2014.

International Alloy Designations and Chemical Composition Limits for Wrought Aluminum and Wrought Aluminum Alloys, Teal Sheets, Aluminum Association (2009).

International Alloy Designations and Chemical Composition Limits for Wrought Aluminum and Wrought Aluminum Alloys, Teal Sheets, Aluminum Association (2015).

* cited by examiner

*Primary Examiner* — Scott Kastler

(74) *Attorney, Agent, or Firm* — Vorys, Sater, Seymour and Pease LLP

(57) ABSTRACT

A method of manufacturing aluminium alloy rolled sheet with excellent formability and suitable for an automotive body, the method including: casting an ingot of aluminium alloy of, in wt. %: Si 0.5 to 1.5, Mg 0.2 to 0.7, Fe 0.03 to 0.30, Cu up to 0.30, optionally one or more elements selected from the group of: (Mn, Zr, Cr, V), Zn up to 0.3, Ti up to 0.15, impurities and aluminium; homogenising the cast ingot at 450° C. or more; hot rolling the ingot to a hot-rolled product; cold rolling the hot-rolled product to a cold-rolled product of intermediate gauge; continuous intermediate annealing the cold-rolled product of intermediate gauge in the range of 360-580° C.; cold rolling the intermediate annealed cold-rolled product to a sheet of final gauge up to 2.5 mm; solution heat treating the sheet; and quenching the solution heat treated sheet.

24 Claims, No Drawings

METHOD OF MANUFACTURING AN AL—MG—SI ALLOY ROLLED SHEET PRODUCT WITH EXCELLENT FORMABILITY

CROSS-REFERENCE TO RELATED APPLICATIONS

This is a § 371 National Stage Application of International Application No. PCT/EP2014/053100 filed on Feb. 18, 2014, claiming the priority of European Patent Application No. 13158176.1 filed on Mar. 7, 2013.

FIELD OF THE INVENTION

The invention relates to a method of manufacturing an Al—Mg—Si aluminium alloy rolled sheet product with excellent formability. The sheet product can be applied ideally as automotive body sheet.

BACKGROUND TO THE INVENTION

As will be appreciated herein below, except as otherwise indicated, aluminium alloy designations and temper designations refer to the Aluminium Association designations in Aluminium Standards and Data and the Registration Records, as published by the Aluminium Association in 2013 and are well known to the person skilled in the art.

For any description of alloy compositions or preferred alloy compositions, all references to percentages are by weight percent unless otherwise indicated.

For this invention the term "sheet" or "sheet product" refers to a rolled product form up to 2.5 mm in thickness.

Generally, outer body panels of a vehicle require excellent physical properties in formability, dent-resistance, corrosion resistance and surface quality. However, the conventional AA5000-series alloy sheets have not been favoured because they have low mechanical strength even after press forming and may also exhibit poor surface quality. Therefore, 6000-series sheet alloys have been increasingly used. The 6000-series alloys provide excellent bake hardenability after painting and high mechanical strength as a result, thus making it possible to manufacture more thin-gauged and more light-weight sheets in combination with a class A surface finish.

U.S. Pat. No. 4,174,232 discloses a process for fabricating age-hardenable aluminium alloys of the Al—Mg—Si type using a specific annealing process. The disclosed aluminium is also embraced by the registered AA6016 alloy. The chemical composition of the registered AA6016 is, in wt. %:

Si 1.0 to 1.5
Mg 0.20 to 0.6
Fe up to 0.50
Cu up to 0.25
Mn up to 0.20
Cr up to 0.10
Zn up to 0.20
Ti up to 0.15,
impurities each <0.05, total <0.15, balance aluminium.

The AA6016 rolled sheet products in the higher strength range when used for automotive parts are known to have limited formability and limited hemming performance.

There is a need for selection of aluminium alloy rolled sheet products and methods for producing vehicle parts or members providing good strength and levels of formability into vehicle parts.

DESCRIPTION OF THE INVENTION

It is an object of the invention to provide a method of manufacturing an Al—Mg—Si alloy or AA6000-series alloy rolled sheet product having improved formability.

It is another object of the invention to provide a method, or at least an alternative method, of manufacturing an Al—Mg—Si alloy or AA6000-series alloy rolled sheet product having improved formability wherein the sheet product has an anisotropy of Lankford value of 0.35 or more.

These and other objects and further advantages are met or exceeded by the present invention and providing a method of manufacturing an aluminium alloy rolled sheet product with excellent formability and paint bake hardenability, and preferably the sheet product has an anisotropy of Lankford value of 0.35 or more, and is particularly suitable for use for an automotive body part, the method comprising the processing steps of:

(a) casting an ingot of an aluminium alloy having a composition consisting of, in wt. %: Si 0.5 to 1.5, Mg 0.2 to 0.7, Fe 0.03 to 0.3, Cu up to 0.30, optionally one or more elements selected from the group consisting of: (Mn 0.01 to 0.5, Zr 0.01 to 0.15, Cr 0.01 to 0.15, V 0.01 to 0.2), Zn up to 0.3, Ti up to 0.15, impurities each <0.05, total <0.20, balance aluminium;

(b) homogenising the cast ingot at a temperature of 450° C. or more;

(c) hot rolling the ingot to a hot-rolled product;

(d) cold rolling of the hot-rolled product to a cold-rolled product of intermediate gauge;

(e) continuous intermediate annealing of the cold-rolled product of intermediate gauge at a temperature in the range of 360° C. to 580° C.;

(f) cold rolling of the intermediate annealed cold-rolled product to a sheet product of final gauge up to 2.5 mm, and preferably in a range of 0.7 mm to 2 mm, and more preferably in a range of 0.8 mm to 1.5 mm;

(g) solution heat treating said sheet product at a temperature range of 500° C. or more; and (h) quenching said solution heat treated sheet product, for example by means of water such as water quenching or water spray quenching.

In accordance with the invention it has been found that a relatively low Fe content in the aluminium alloy in combination with the continuous intermediate annealing provides for an improved formability, and improved deep drawability in particular.

Preferably the aluminium sheet product has an anisotropy of Lankford value of 0.4 or more, and more preferably of 0.5 or more.

Surprisingly, the aluminium sheet product manufactured in accordance with this method has not only a high anisotropy of Lankford value but also a high r-value in the L- and LT-direction. Typically an r-value in the L-direction (rolling direction) of at least 0.75, and preferably of at least 0.80, and more preferably of at least 0.90. And the aluminium sheet product has typically an r-value in the LT-direction (transverse direction relative to the rolling direction) of at least 0.65, and preferably of at least 0.75, and more preferably of at least 0.80.

Homogenisation should be performed at a temperature of 450° C. or more. If the homogenisation temperature is less than 450° C., reduction of ingot segregation and homogenisation may be insufficient. This results in insufficient dissolution of $Mg_2Si$ components which contribute to strength, whereby formability may be decreased. Homogenisation is preferably performed at a temperature of 480° C.

or more, more preferably at least one homogenisation step is performed at a temperature range of 540° C. to 580° C. The heat-up rates that can be applied are those which are regular in the art.

The soaking times for homogenisation should be at least about 2 hours, and more preferably at least about 10 hours. A preferred upper-limit for the homogenisation soaking time is about 48 hours, and more preferably 24 hours.

In an embodiment of the invention the anisotropy of Lankford value can be further increased by adopting a hot rolling practice wherein the hot-mill exit temperature, and which is the temperature at which the hot rolled material is being coiled, is relatively high, typically above 260° C., preferably more than about 300° C., and more preferably more than 340° C. The hot-mill exit temperature should not be too high and preferably does not exceed 400° C., preferably it does not exceed 380° C., and more preferably is not more than 360° C.

An essential processing step in the method according to this invention is the application of a continuous intermediate annealing treatment at an annealing temperature in the range of 360° C. to 580° C. to achieve recrystalisation in the aluminium sheet which influences the crystallographic texture development which is believed to result in the desirable high anisotropy of Lankford value and r-values in L- and LT-direction. A preferred lower-limit for the annealing temperature is 380° C., and more preferably 400° C. A preferred upper-limit for the annealing temperature is 500° C., and more preferably 460° C. To take full benefit of the continuous intermediate annealing treatment in order to achieve the improved formability, the temperature of aluminium sheet should be rapidly increased on entry into the continuous annealing furnace, soaked at the annealing temperature for a limited period of time, and after soaking preferably rapidly cooled, for example by means of quenching, to below 150° C., and preferably to below 100° C. The heating rate of the aluminium sheet in the heating section of the continuous annealing furnace is at least 1° C./s or more, and preferably at least 10° C./s or more, and more preferably at least 50° C./s or more, for example about 70° C./s or about 100° C./s. The soaking time at the annealing temperature is at least 1 second, and preferably at least 5 seconds. The soaking time at annealing temperature should preferably not exceed 300 seconds. More preferably it does not exceed 60 seconds, and most preferably it does not exceed 30 seconds. Immediately following annealing the aluminium sheet is rapidly cooled using a cooling rate of at least 1° C./s, and preferably of at least 10° C./s, and more preferably of at least 100° C./s.

In a preferred embodiment of the method the solution heat-treatment temperature is relatively low, but should at least exceed 500° C., and is preferably in a range of 530° C. to 560° C., and more preferably in the range of 540° C. to 555° C., and is more preferably just above the solvus temperature of the $Mg_2Si$ and Si phases, to further improve formability characteristics of the aluminium alloy sheet product.

In an embodiment of the invention, following the solution heat treatment and quenching of the sheet product, the sheet product is subjected to pre-ageing and natural ageing prior to forming into an automotive body member.

In an embodiment of the invention, following the solution heat treatment and quenching of the sheet product, the sheet product is subjected to reversion treatment, preferably at a temperature of 170° C. to 230° C. for 60 seconds or less within seven days after the solution heat treatment and prior to forming into an automotive body member.

A formed automotive body member includes bumpers, doors, hoods, trunk lids, fenders, floors, wheels and other portions of an automotive or vehicle body. Due to its excellent deep drawing properties the alloy sheet product is also perfectly suited to produce also inner door panels, wheel arch inner panels, side panels, spare wheel carrier panels and similar panels with a high deep drawing height. Forming includes deep-drawing, pressing, and stamping.

Following the forming operation the formed part is made part of an assembly of other metal components as regular in the art for manufacturing vehicle components, and subjected to a paint bake operation to cure any paint or lacquer layer applied. The paint bake operation or cycle comprises one or more sequential short heat treatment in the range of 140° C. to 210° C. for a period of 10 to less than 40 minutes, and typically of less than 30 minutes. A typical paint bake cycle would comprise a first heat treatment of 180° C.@ 20 minutes, cooling to ambient temperature, then 160° C.@ 20 minutes and cooling to ambient temperature. In dependence of the OEM such a paint bake cycle may comprise of 2 to 5 sequential steps and includes drying steps.

In an embodiment the aluminium alloy has a composition within the ranges of AA6016, AA6016A, AA6116, AA6005A, AA6014, AA6022, or AA6451, and with more preferred narrow ranges as set out herein below.

In a particular embodiment the aluminium alloy has a composition with the range of AA6016A.

In a particular embodiment the aluminium alloy has a composition with the range of AA6022.

Effects and reasons for limitations of the alloying elements in the Al—Mg—Si alloy sheet manufactured in accordance with the method of the present invention are described below.

The purposive addition of Mg and Si strengthens the alloy due to precipitation hardening of elemental Si and $Mg_2Si$ formed under the co-presence of Mg. In order to provide a sufficient strength level in the sheet product according to the invention the Si content should be at least 0.5%, and preferably at least 0.6%, and more preferably at least 0.9%. A preferred upper-limit for the Si content is 1.3%, and more preferably 1.2%. The presence of Si enhances also the formability.

Substantially for the same reason as for the Si content, the Mg content should be at least 0.2%, and preferably at least 0.3%, and more preferably at least 0.35% to provide sufficient strength to the sheet product. A preferred upper-limit for the Mg content is 0.5%.

In an alternative embodiment of the aluminium alloy the Si is in a range of 0.5% to 0.7% in combination with a Mg level in a range of 0.5% to 0.7% to provide an improved balance of strength and formability.

It is important that the Fe content in the alloy sheet product should not exceed 0.3%, and preferably it should not exceed 0.25%, in order to obtain the improved formability. A more preferred upper-limit for the Fe content is 0.18%, and more preferably 0.15%, and even more preferably 0.12%. A lower Fe-content is favourable for the formability of the sheet product. A lower limit for the Fe-content is 0.03%, and preferably 0.05%, and more preferably 0.06%. A too low Fe content may lead to undesirable recrystallized grain coarsening and makes the aluminium alloy too expensive.

Each of Mn, Cr, V and Zr could be present to control the grain size in the alloy sheet product.

In a preferred embodiment at least Mn is present in a range of 0.01% to 0.5%. A preferred lower-limit for the Mn content is about 0.05%. A more preferred upper-limit for the Mn content is about 0.25%, and more preferably 0.2%. Mn is added for grain size control.

In a preferred embodiment there is a purposive addition of Cr in a range of 0.01% to 0.15%. A preferred upper-limit for the Cr addition is about 0.10%, and more preferably 0.08%, and more preferably 0.05%.

In a preferred embodiment there is a purposive addition of at least Mn in combination with Cr.

Cu can be present in the sheet product, but it should not exceed 0.30%, in order to maintain a good corrosion performance. In a preferred embodiment Cu is purposively added in a range of at least 0.01%, and preferably of at least 0.02%. A preferred upper-limit for the Cu is 0.2%, and more preferably 0.15%, and most preferably 0.10%.

Zn is an impurity element that can be tolerated up to 0.3%, and is preferably as low as possible, e.g. 0.1% or less.

Ti can be added to the sheet product amongst others for grain refiner purposes during casting of the alloy ingots. The addition of Ti should not exceed about 0.15%, and preferably it should not exceed about 0.1%. A preferred lower limit for the Ti addition is about 0.01%, and typically a preferred upper-limit for Ti is about 0.05%, and can be added as a sole element or with either boron or carbon serving as a casting aid, for grain size control.

Unavoidable impurities can be present up to 0.05% each, and a total of 0.20%, the balance is made with aluminium.

The invention will now be illustrated with reference to a non-limiting embodiment according to the invention.

EXAMPLE

On an industrial scale aluminium sheet products of two slightly differing composition have been manufactured using different processing routes. The alloy composition of the two alloys are listed in Table 1, and wherein the main difference is in the Fe-content. Various properties have been determined in the T4 condition of the sheet material and are summarised in Table 2.

All ingots have been EMC cast to rolling ingots having a thickness of about 500 mm, homogenised for 10 hours at 560° C., then hot rolled to 7.5 mm gauge and coiled at a temperature of 350° C. Cold rolled to 3 mm and intermediate annealed (IA) either via batch annealing or via continuous annealing, then further cold rolled to 1 mm and solution heat treated for 10 s at 550° C., quenched and pre-aged.

The batch annealing included a heat-up of 30° C./h to 380° C. and soaking for 1 hour at this temperature, followed by coil cooling.

The continuous annealing included a heat-up rate of 100° C./s to 450° C. and soaking at this temperature for about 2 s. followed by water quenching.

Tensile properties (tensile strength (UTS), yield strength (YS), total elongation (A80) and uniform elongation (Au)) have been measured after 6 weeks of natural ageing (a T4 condition) by performing a tensile test.

Anisotropy of Lankford values, commonly also known as delta-r or Δr or as the planar anisotropy coefficient, were determined by collecting tensile specimens in three directions (at 0°, 45° and 90° to the rolling direction), and subjected to a tensile test to determine the r values at 10% deformation, and to calculate the anisotropy of Lankford value using the equation: $\frac{1}{2}.(R_0-2.R_{45}+R_{90})$.

Bake hardenability (BH) has been assessed also by measuring the yield strength (YS) after the 6 weeks of natural ageing and by subsequent applying 2% tensile deformation and performing a heat treatment at 185° C. for 20 minutes in an oil bath. A test material having a yield strength of 200 MPa or more was accepted.

TABLE 1

Chemical composition, in weight percent, balance impurities and aluminium.

| Alloy | Si | Fe | Cu | Mn | Mg | Cr | Ti |
|---|---|---|---|---|---|---|---|
| 1 | 1.2 | 0.1 | 0.06 | 0.1 | 0.40 | 0.03 | 0.02 |
| 2 | 1.2 | 0.2 | 0.06 | 0.1 | 0.37 | 0.03 | 0.02 |

TABLE 2

Test results.

| | | T4 | | | | | | | | | |
|---|---|---|---|---|---|---|---|---|---|---|---|
| | | Tensile properties | | | | r-value and Δr | | | | Average | BH |
| alloy | IA | YS (MPa) | UTS (MPa) | A80 (%) | Au (%) | 90° r10 | 0° r10 | 45° r10 | Δr | grain size (μm) | YS (MPa) |
| 1 | batch | 116 | 231 | 27.1 | 22.9 | 0.69 | 0.85 | 0.38 | 0.39 | 25 | 214 |
| 2 | batch | 113 | 226 | 25.8 | 22.9 | 0.63 | 0.75 | 0.39 | 0.30 | 20 | 204 |
| 1 | cont. | 120 | 237 | 27.7 | 23.0 | 0.8 | 0.91 | 0.33 | 0.52 | 24 | 223 |
| 2 | cont. | 115 | 228 | 26.3 | 22.6 | 0.66 | 0.8 | 0.25 | 0.48 | 24 | 203 |

From the results of Table 2 it can be seen that there is a significant effect of the Fe content in the aluminium alloy on the anisotropy of Lankford values or Δr, both for batch annealing and continuous annealing. A lower Fe-content (alloy 1) results in higher anisotropy of Lankford values.

The intermediate annealing process (batch v. continuous) appears to have no significant influence on the grain size in the sheet product.

The Fe-content appears to have also an effect on the bake hardenability, whereby a lower Fe-content (alloy 1) results in a higher yield strength, at least in this simulated paint bake cycle.

In accordance with the invention it has been found that continuous interannealing during cold rolling in combination with the lower Fe-content results in the very favourable property combination of increased anisotropy of Lankford values, increased r-values on both 0° and 90° direction, high tensile elongation and high yield strength after paint bake simulation. This makes the aluminium alloy sheet a good candidate for manufacturing formed automotive parts, in particular when formed via deep drawing processes.

The invention is not limited to the embodiments described before, which may be varied widely within the scope of the invention as defined by the appending claims.

The invention claimed is:

1. A method of manufacturing an aluminium alloy rolled sheet product with excellent formability and paint bake hardenability and particularly suitable for use for an automotive body, the method comprising:

(a) casting an ingot of an aluminium alloy having a composition consisting of, in wt. %:
Si 0.5 to 1.5,
Mg 0.2 to 0.7,
Fe 0.03 to 0.30,
Cu up to 0.30,
optionally one or more elements selected from the group consisting of:
Mn 0.01 to 0.5, Zr 0.01 to 0.15, Cr 0.01 to 0.15, V 0.01 to 0.2,
Zn up to 0.3,
Ti up to 0.15,
impurities each <0.05, total <0.20, balance aluminium;

(b) homogenising the cast ingot at a homogenising temperature of 450° C. or more;

(c) hot rolling the ingot to a hot-rolled product;

(d) cold rolling the hot-rolled product to a cold-rolled product of intermediate gauge;

(e) continuous intermediate annealing the cold-rolled product of intermediate gauge at an annealing temperature in the range of 360° C. to 580° C., wherein a heat-up rate of the cold-rolled product of intermediate gauge for the continuous intermediate annealing is more than 1° C./s;

(f) cold rolling the intermediate annealed cold-rolled product to a sheet product of final gauge up to 2.5 mm;

(g) solution heat treating said sheet product at a solution heat treating temperature range of 500° C. or more; and (h) quenching said solution heat treated sheet product.

2. The method according to claim 1, wherein the sheet product has an anisotropy of Lankford value of 0.35 or more.

3. The method according to claim 1, wherein the solution heat-treated and quenched sheet product is pre-aged and naturally aged prior to forming into an automotive body member.

4. The method according to claim 1, wherein the solution heat-treated and quenched sheet product is reversion heat treated prior to forming into an automotive body member.

5. The method according to claim 1, wherein the annealing temperature of the continuous intermediate annealing of the cold-rolled product of intermediate gauge is in a range of 380° C. to 500° C.

6. The method according to claim 1, wherein soaking time for the continuous intermediate annealing is at least 1 s.

7. The method according to claim 1, wherein the cold-rolled product of intermediate gauge is rapidly cooled following soaking at the annealing temperature.

8. The method according to claim 1, wherein during hot rolling the ingot has a hot-mill exit temperature in the range of 300° C. to 400° C.

9. The method according to claim 1, wherein the aluminium alloy has a composition within the ranges of AA6016, AA6016A, AA6116, AA6005A, AA6014, AA6022, or AA6451.

10. The method according to claim 1, wherein the aluminium alloy has Fe content in the range of 0.05% to 0.18%.

11. The method according to claim 1, wherein the aluminium alloy has Si content in the range of 0.9% to 1.3%.

12. The method according to claim 1, wherein the aluminium alloy has Mg content in the range of 0.3% to 0.5%.

13. The method according to claim 1, wherein the aluminium alloy has Si content in the range of 0.5% to 0.7% and Mg content in the range of 0.5% to 0.7%.

14. The method according to claim 1, wherein the aluminium alloy has Mn content in the range of 0.05% to 0.25%.

15. The method according to claim 1, wherein the aluminium alloy has Cu content in the range of 0.01% to 0.2%.

16. The method according to claim 1, wherein the aluminium alloy rolled sheet product forms an inner door panel of a car.

17. The method according to claim 1, wherein the aluminium alloy rolled sheet product forms a side panel of a car.

18. The method according to claim 1, wherein the sheet product has an anisotropy of Lankford value of 0.4 or more.

19. The method according to claim 1, wherein the heat-up rate of the cold-rolled product of intermediate gauge for the continuous intermediate annealing is at least 10° C./s.

20. The method according to claim 1, wherein soaking time for the continuous intermediate annealing is not more than 300 s.

21. The method according to claim 1, wherein the aluminium alloy has Fe content in the range of 0.06% to 0.15%.

22. The method according to claim 1, wherein the aluminium alloy has Mg content in the range of 0.35% to 0.5%.

23. The method according to claim 1, wherein the aluminium alloy has Cu content in the range of 0.02% to 0.15%.

24. The method according to claim 1, wherein the aluminium alloy composition consists of, in wt. %:
Si 0.9% to 1.2,
Mg 0.35% to 0.5,
Fe 0.06% to 0.15,
Cu 0.02% to 0.10,
Cr 0.01 to 0.15,
Mn 0.01 to 0.5,
Zn up to 0.1,
Ti 0.01 to 0.05,
impurities each <0.05, total <0.20, balance aluminium,
wherein during hot rolling the ingot has a hot-mill exit temperature in the range of 340° C. to 380° C.,
wherein the annealing temperature of the continuous intermediate annealing of the cold-rolled product of intermediate gauge is in a range 400° C. to 460° C.,
wherein the heat-up rate of the cold-rolled product of intermediate gauge for the continuous intermediate annealing is at least 50° C./s,
wherein soaking time for the continuous intermediate annealing is not more than 60 s, and
wherein the sheet product has an anisotropy of Lankford value of 0.5 or more.

* * * * *